US005263705A

United States Patent [19]

Schmaling

[11] Patent Number: 5,263,705

[45] Date of Patent: * Nov. 23, 1993

[54] DOCUMENT REGISTRATION APPARATUS WITH SKEW ADJUSTMENT

[75] Inventor: Roderick N. Schmaling, Brookfield Center, Conn.

[73] Assignee: Pitney Bowes Inc., Stamford, Conn.

[ * ] Notice: The portion of the term of this patent subsequent to Jul. 27, 2010 has been disclaimed.

[21] Appl. No.: 906,200

[22] Filed: Jun. 29, 1992

[51] Int. Cl.[5] ..... B65H 9/04

[52] U.S. Cl. ..... 271/246; 414/789; 198/463.4; 198/434

[58] Field of Search ..... 271/245, 246; 414/789; 198/463.4, 434

[56] References Cited

U.S. PATENT DOCUMENTS

| | | | |
|---|---|---|---|
| 824,755 | 7/1906 | Sturtevant . | |
| 3,136,325 | 6/1965 | Belder | 271/246 X |
| 3,637,203 | 1/1972 | French | 271/53 |
| 3,661,383 | 5/1972 | Morrison | 271/51 |
| 4,073,391 | 2/1978 | O'Brien et al. | 271/246 X |
| 4,078,790 | 3/1978 | Stocker | 271/213 |
| 4,533,135 | 8/1985 | Barker | 271/275 |
| 4,570,923 | 2/1986 | Hooper et al. | 271/275 |
| 4,606,536 | 8/1986 | Ohara | 271/118 |
| 4,630,815 | 12/1986 | Petersen et al. | 271/273 |
| 4,750,853 | 6/1988 | Van Soest et al. | 414/43 |
| 4,815,726 | 3/1989 | Pagowski et al. | 271/274 |
| 5,080,347 | 1/1992 | Funada | 271/246 X |

FOREIGN PATENT DOCUMENTS

| | | | |
|---|---|---|---|
| 0280150 | 12/1987 | Japan | 271/246 |
| 0171738 | 7/1988 | Japan | 271/246 |

*Primary Examiner*—H. Grant Skaggs
*Assistant Examiner*—Carol Lynn Druzbick
*Attorney, Agent, or Firm*—Charles R. Malandra, Jr.; Melvin Scolnick

[57] ABSTRACT

A document registration apparatus for use in a document inserting station or a document queuing station is provided. The apparatus includes a document registration unit having a plurality of laterally-spaced registration stops which pivot about a horizontal axis for stopping motion of a document and registering a particular edge of a document to a particular direction in the apparatus. There is at least one urge roller for moving the registered document away from the apparatus for further processing. The document registration apparatus also includes structure for pivoting the documentation registration unit about a vertical axis for skew adjustment of the registration unit.

21 Claims, 7 Drawing Sheets

10
27
28
15
14
25
25A
12
13
13
16
31
20
20B
49
A
21
B
32
34
D
11

DOCUMENT REGISTRATION APPARATUS WITH SKEW ADJUSTMENT

RELATED APPLICATIONS

The present application is related to U.S. application Ser. No. 07/906,170, filed concurrently herewith; and U.S. application Ser. No. 808,863, filed Dec. 17, 1991, each of which co-pending applications is assigned to the assignee of the present invention. The specific and entire disclosure each of the aforementioned applications is specifically incorporated herein by reference for the purpose of further explaining the nature of the present invention.

FIELD OF THE INVENTION

The present invention relates to a document registration apparatus for use in a document processing system, and more particularly, for use in a document queuing station.

BACKGROUND OF THE INVENTION

Various document processing systems, such as in an inserting machine, require that a document is aligned relative to a particular station in the system prior to being processed at the station. Typically, this is accomplished by registering a particular edge of the document in a particular direction in the system. For example, documents must be aligned before being conveyed to a folding apparatus to achieve a proper fold. Also, enclosures which are to be inserted into an envelope should be aligned relative to the envelope prior to insertion in order to avoid processing difficulties. Furthermore, some documents which are to be transported away from a particular queuing station, to another adjacent document raceway, should be aligned at the queuing station relative to the raceway, in order to facilitate the processing of the documents.

Devices which register a particular edge of a document to a particular direction are known. See, for example, U.S. Pat. Nos. 3,637,203, 4,078,790 and 4,925,180, which utilize stops that pivot into position to stop the advancement of documents being conveyed in a particular direction. Some registration devices, such as stationary side guides, perform the task of aligning the document while the document is being conveyed. Other registration devices, such as a "queuing" station, perform the dual task of aligning the document and stopping the document until the next successive station is ready to receive the document for further processing. Typically, queuing stations comprise mechanisms which register the document by stopping or queuing the document and which are subject to frequent mechanical failure because of the complex nature of their mechanical design. Document registration devices should be able to repeatedly process a great number of documents before repair or replacement is necessary.

In U.S. patent application Ser. No. 808,863, filed on Dec. 17, 1991, and assigned to the assignee of the present invention, a document registration apparatus in the form of a queuing station is disclosed. The apparatus has a plurality of registration stops for stopping motion of a document and registering a particular edge of a document to a particular direction in the apparatus. The registration apparatus also includes at least one urge roller for moving the registered document away from the apparatus for further processing. The document registration apparatus also includes a jam access hinge for providing access to a jammed document. However, the apparatus disclosed in U.S. patent application Ser. No. 808,863 does not include means for adjusting for skew to properly set the alignment.

A drawback present in some known document registration devices is that it can be difficult to adjust the device to the proper alignment. It is well known that there is a need to adjust such registration devices for skew. Adjusting for skew aligns the registration device so that the document is conveyed from the registration device parallel with the center line of the paper path. For a stationary device, such as with side guides, this would not be a difficult task. However, for other devices, such as a queuing station which comprises a plurality of components and performs multiple tasks, each of the individual parts must be aligned relative to each other in order for the overall apparatus to be properly aligned to a particular chosen direction without interfering with the stopping mechanism. Furthermore, once the alignment is set at a station, further adjustments may become necessary to maintain alignment. In particular, adjustments may be needed when the type of documents being processed is changed, or when the registration device goes out of alignment causing skewing of the documents at the next successive station. When the number of parts in the registration device is large, the alignment adjustment can be time consuming.

A document registration apparatus which simultaneously queues and aligns a stack of documents can also suffer from drawbacks associated with the mechanical design of the apparatus. For example, the design and operation of a queuing station may result in undesirable "shingling" of documents where the top document in the stack is not directly above the lower documents but slightly shifted forward or backward. This can occur, for example, when the exit pinch rollers are mounted in such a way that the transport system cannot maintain a square alignment when a document stack exits the station.

SUMMARY OF THE INVENTION

In light of the above, it has been found that a document registration apparatus which is not subject to frequent mechanical failure because of the nature of its mechanical design can include a skew adjustment mechanism to improve its performance. It has been found that a document registration apparatus utilizing a plurality of stops can include a skew adjustment mechanism which adjusts for skew by pivoting the plane of the stops by a turn of a screw.

It has also been found that for a document registration apparatus suitable for a queuing station which provides adjustments for the handling of documents of various lengths, that a separate adjustment mechanism for skew is compatible with and does not interfere with the adjustment for document length.

Thus the present invention includes a unique feature to adjust the skew of the document at a queuing station registration apparatus. The present invention provides a document registration apparatus which includes a skew adjustment that is easy to handle and which maintains the adjustment once set.

In accordance with the present invention there is provided a document registration apparatus for use with a conveying means for transporting a document along a path from an upstream direction to a downstream direction through a document registration position. The document registration apparatus includes a document registration unit positioned above the document registration position in the document path, a plurality of laterally-spaced registration stops at the downstream end of the registration unit positioned substantially perpendicularly to the document path for both stopping a document at the document registration position and for aligning the document relative to the document path when the registration stops are lowered adjacent to the document path, and at least one urge roller at the upstream end of the registration unit for urging a stopped document against the conveying means when the registration stops are raised above the document path to move the document from the document registration position in the downstream direction. The apparatus also has a first pivoting means for pivoting the registration stops about a horizontal pivoting axis in the registration unit for selectively lowering and raising the registration stops. The document registration apparatus further comprises second pivoting means for pivoting the documentation registration unit about a vertical axis for skew adjustment of the registration unit.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
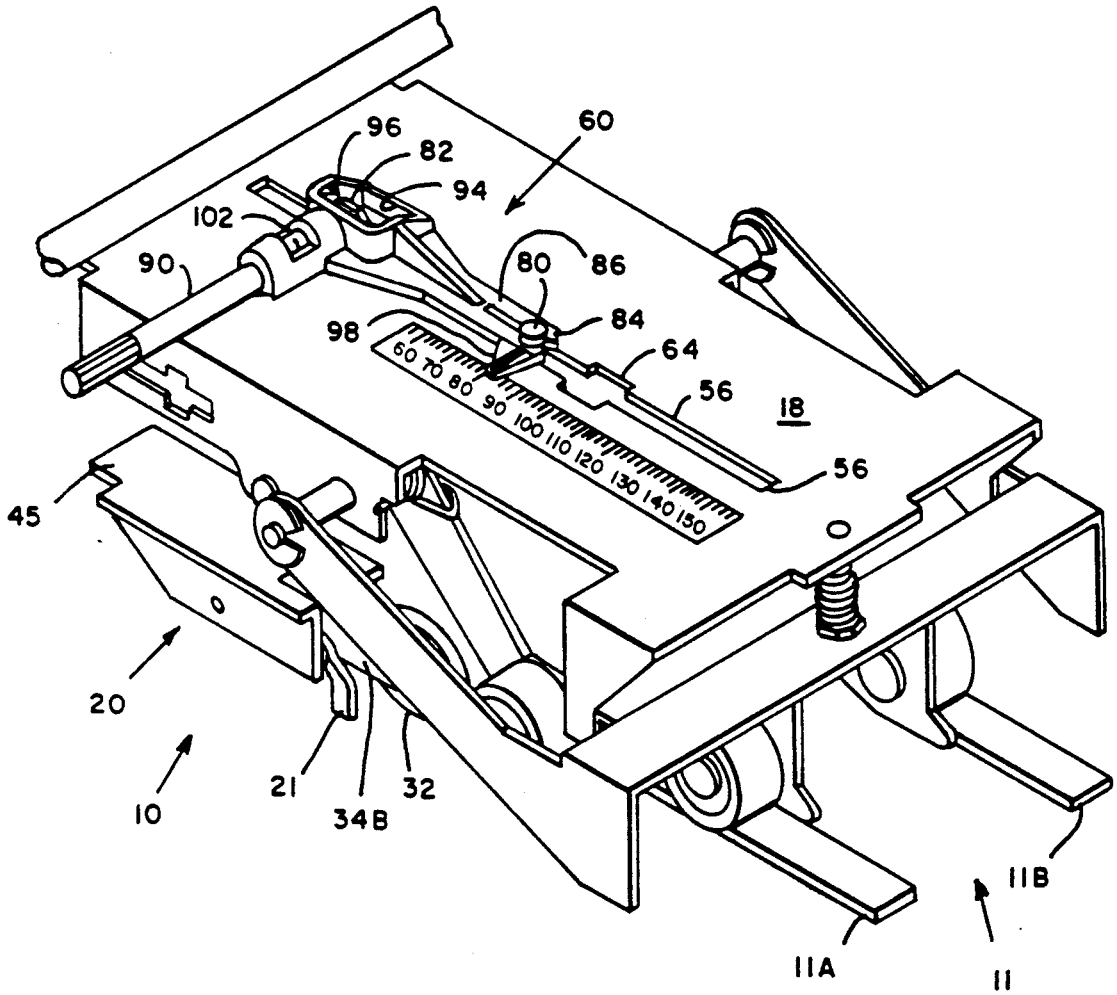
FIG. 1 is a perspective view of the preferred embodiment of a document registration apparatus according to the present invention.

The present invention is part of a document processing system, such as an inserting machine, comprising a plurality of stations situated successively along a paper path for processing documents conveyed along the path. With reference to FIGS. 1-7, a document registration apparatus, generally shown as 10, is used in conjunction with a document transport system, generally designated 11. As shown in FIG. 3, registration apparatus 10 cooperates with transport system 11 in transporting a document 12 along a path 13 in an upstream to downstream direction, designated as arrow D. There is a document registration position 16 where document 12 is stopped in its path by registration unit 10 and is held or "queued" until the next successive station in the processing system is ready to process document 12.

The apparatus 10 simultaneously stops and aligns the document 12 conveyed by transport system 11. Document registration apparatus 10 aligns document 12 relative to path 13, or, if desired, some other document raceway in the system. Although FIG. 3 shows a single document 12, it is to be understood that the present invention is applicable to situations where document 12 is a stack of documents.

Document registration apparatus 10 is suitable for use in a queuing station or in an inserting station of an inserting machine wherein document 12 must be stopped and aligned before further processing. Apparatus 10 is suitably mounted to the frame (not shown) of the inserting machine. For example, apparatus 10 can be pivotally mounted at the upstream end to provide easy access for document jams. A more detailed description of such an arrangement is provided in U.S. application Ser. No. 808,863, noted previously herein.

Figure 2:
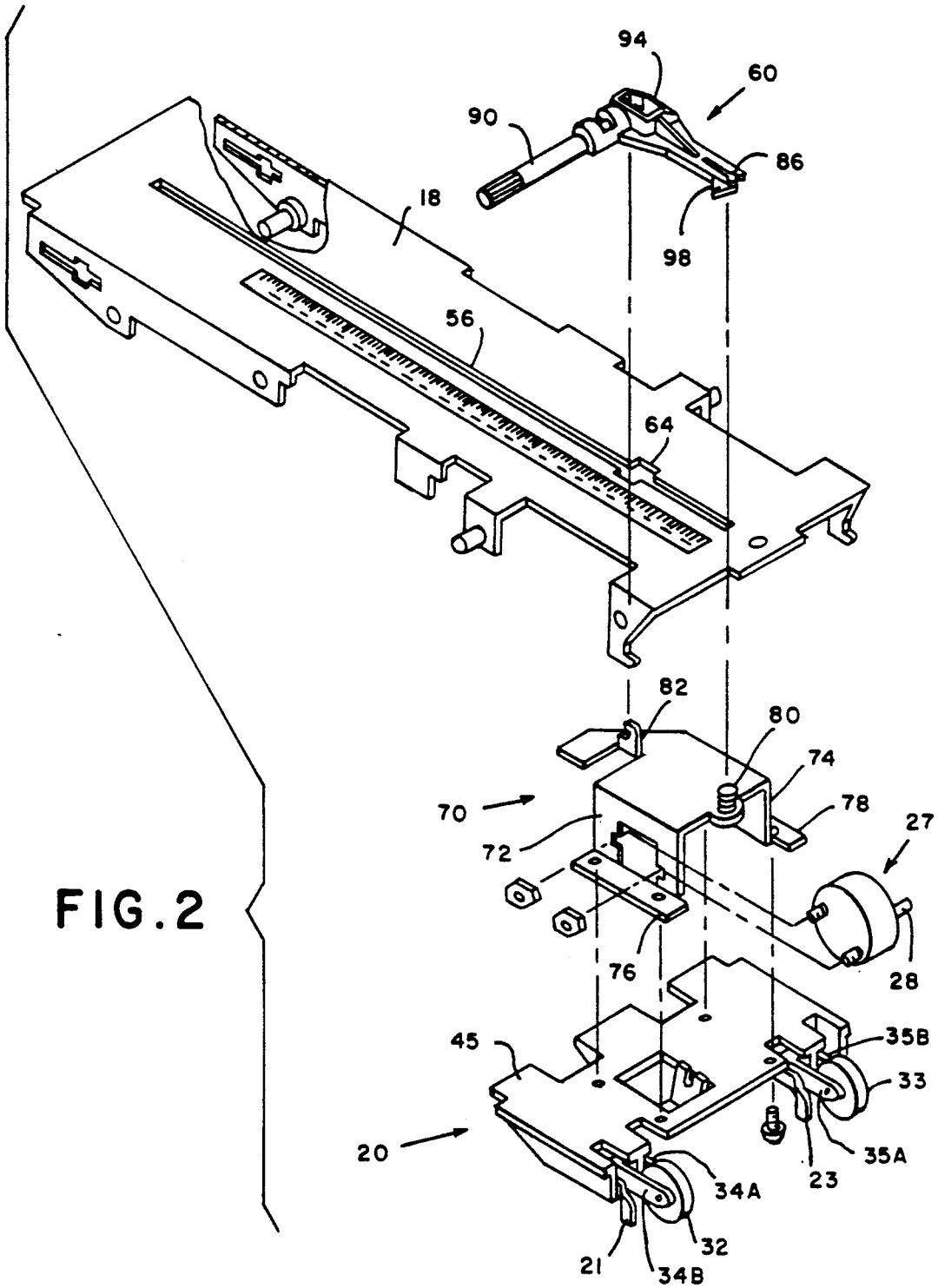
FIG. 2 is an exploded perspective view of a document registration apparatus similar to that shown in FIG. 1 but sized to handle documents of greater length.
Figure 3:
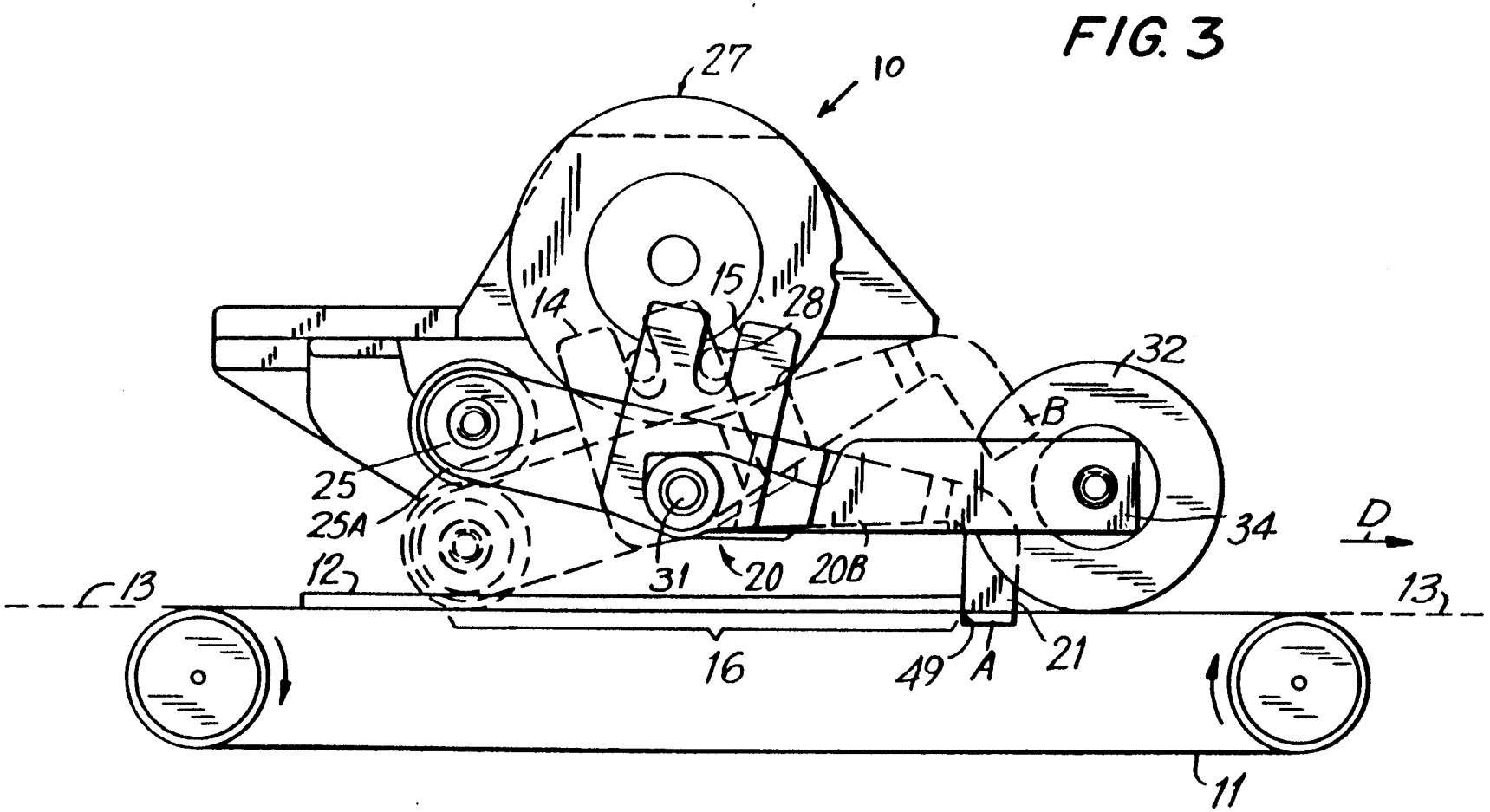
FIG. 3 is a partial side elevational view of the document registration apparatus of FIG. 1.
Figure 4:
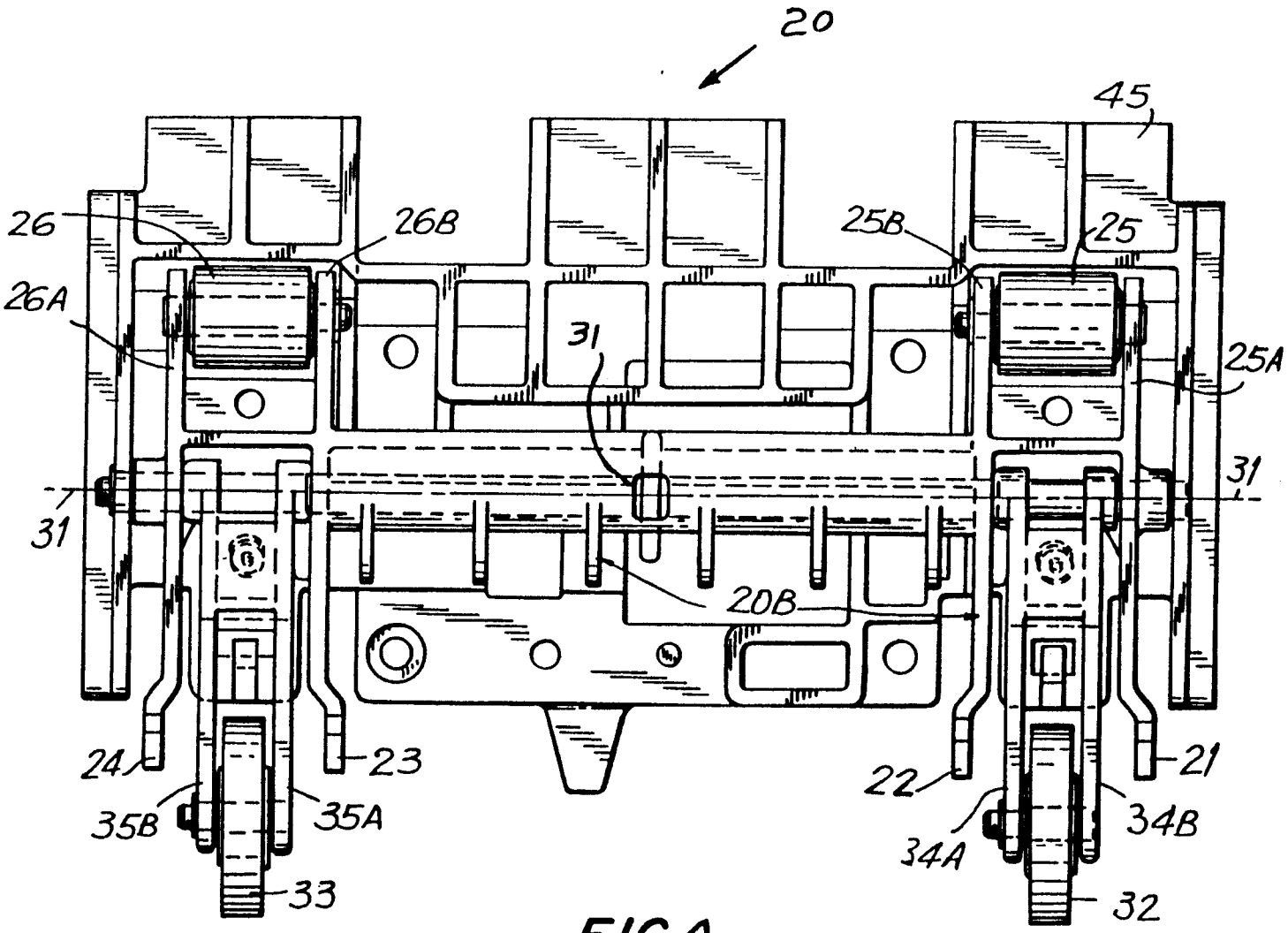
FIG. 4 is a bottom view of the document registration apparatus of FIG. 1.
Figure 5:
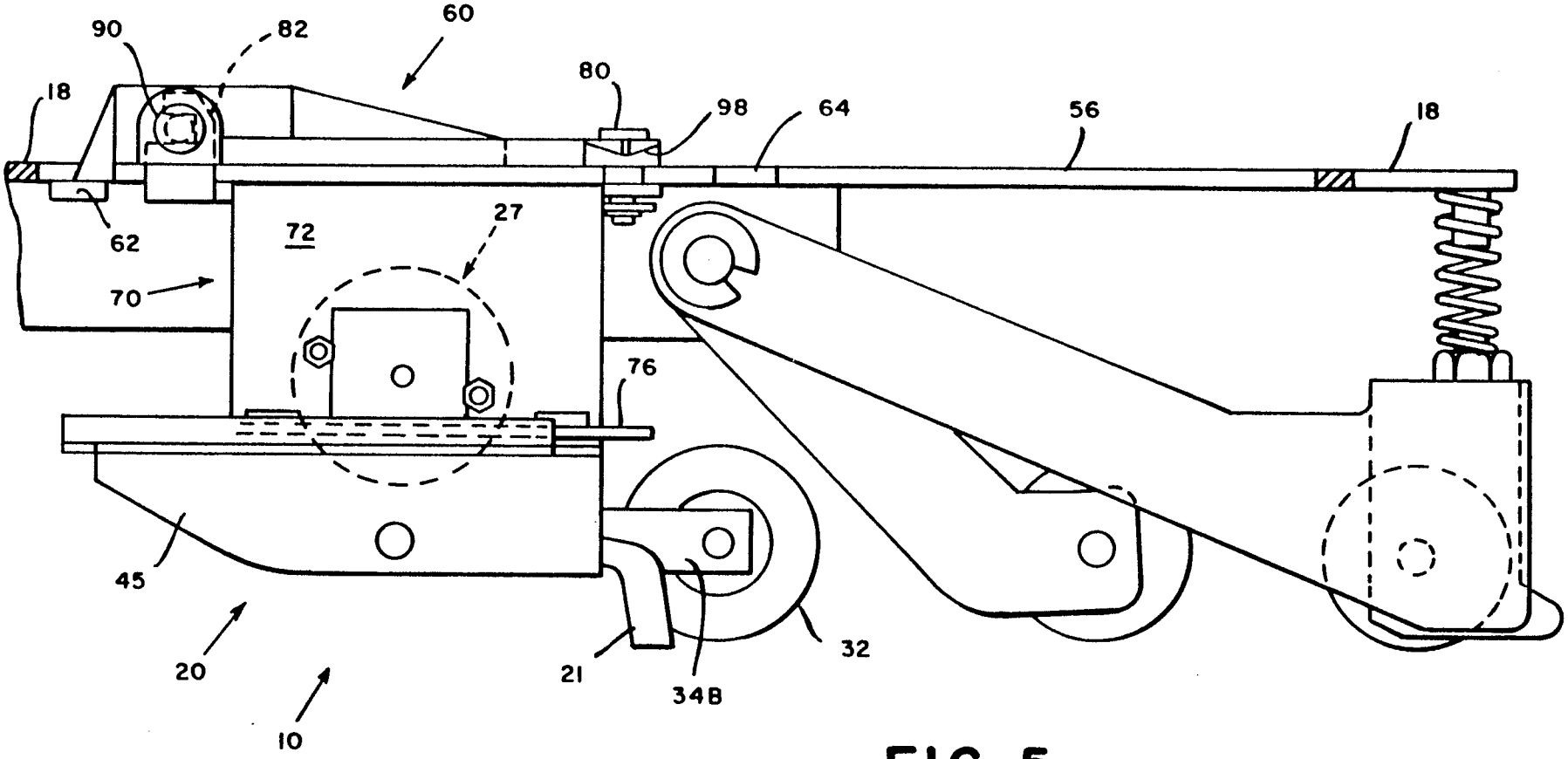
FIG. 5 is a partial side elevational view of the registration apparatus of FIG. 1, showing the relationship among the components effecting the skew adjustment.

Referring now to FIGS. 2, 3 and 4, apparatus 10 comprises a document registration unit 20 pivotally mounted to a top plate 18. Document registration unit 20 preferably comprises a one piece document registration unit holder 45 to which a one piece frame member 20B is attached. Frame member 20B includes four registration stops 21, 22, 23 and 24 on the downstream end thereof and two urge rollers 25 and 26 on urge roller arms 25A-B and 26A-B, respectively, on the upstream end of unit 20. Urge rollers 25 and 26 are spaced at lateral positions between the lateral positions o registration stops 21 and 22 on the one hand, and the lateral positions of registration stops 23 and 24 on the other hand, respectively. Frame member 20B pivots vertically around pivot axis 31. A rotary solenoid 27 is linked to a pivoting arm 14 by a pin 28 which rides in a slot 15 of pivoting arm 14. Pin 28 moves along a circular path on each actuation of solenoid 27 and reciprocates in slot 15, thereby rocking pivot arm 14. As pivot arm 14 rocks, frame member 20B of document registration unit 20 pivots vertically around pivot axis 31.

The combination of registration stops 21-24 and urge rollers 25 and 26 are used to stop and align document 12 at document registration position 16, and then to release it for further processing. The stopped document 12 is aligned at this position so that it can subsequently be processed with minimal skew relative to path 13 or, if desired, some other document raceway as discussed above. For example, if document 12 is an envelope to which enclosures will be inserted, then registration stops 21-24 ensure that the envelope will be aligned relative to the enclosures. This insertion process can take place at document registration position 16 (where the envelope will be held open by an envelope opening claw) or, if desired, at a subsequent location along path 13. Similarly, if document 12 is an enclosure which will be subsequently inserted into an envelope, then registration stops 21-24 ensure that the enclosure will be aligned relative to the envelope. Finally, if document 12 is a sheet or stack of sheets which will subsequently be folded, then registration stops 21-24 ensure that the document is aligned so that the folder can make a square fold of the document.

The registration units shown in FIGS. 1 and 2 are comprised of different lengths with each being suitable for a particular use. For example, the longer apparatus in FIG. 2 may be more suitable for use with a sheet feeder that can feed sheets of different lengths. The shorter apparatus in FIG. 1 may be more suitable at an insertion station or at an enclosure feeder where the length of the document being fed is less than full size sheets.

In order to stop document 12 at document registration position 16, registration stops 21–24 are urged clockwise to position A (FIG. 3) by actuating solenoid 27. In position A, registration stops 21–24 extend into document path 13 and preferably project below the plane of transport system 11, so as to block document 12 from being transported further downstream by transport system 11. In the preferred embodiment, transport system 11 includes two transport belts 11A and 11B (FIGS. 1 and 7) which move in synchronization. Preferably, transport belts 11A and 11B are each approximately 0.5 inch wide. Laterally spaced on each side of each transport belt 11A and 11B are registration stops 21, 22 and 23, 24, respectively. The projection of stops 21–24 below the plane of transport system 11 assures that document 12 cannot slip through. Registration stops 21–24 are laterally-spaced along document registration unit 20 so that when document 12 is stopped at document registration position 16, the downstream edge 49 (see FIGS. 3 and 7) of document 12 is aligned with respect to document path 13 or, if desired, another path with which it is desired to align document 12, for example, one orthogonal to path 13. The continued travel of transport system 11 while document 12 is stopped assures that document 12 registers completely against stops 21–24. When it is time to release document 12, solenoid 27 is actuated to pivot registration stops 21–24 to position B (FIG. 3) wherein urge rollers 25 and 26 urge document 12 against transport belts 11A and 11B, thus increasing the frictional force between document 12 and transport system Il. The increased frictional force is enough to stop the slippage between document 12 and transport system 11 and moves document 12 downstream for further processing.

As document 12 moves in the downstream direction, it encounters exit pinch rollers 32 and 33 which are mounted on independent sets of support arms 34A, 34B and 35A, 35B, corresponding to exit pinch rollers 32 and 33, respectively, and which also pivot about pivoting axis 31. Arms 34A, 34B and 35A, 35B and thus rollers 32 and 33, are respectively spring biased by separate torsion springs (not shown) to urge rollers 32 and 33 against transport belts 11A and 11B. Rollers 32 and 33 move away from belts 11A and 11B when document 12 is released, but move back into engagement with transport system 11 as soon as document 12 is conveyed beyond rollers 32 and 33. The released document is thus urged against transport system 11 and driven while the next document is held. The mounting of pinch rollers 32 and 33 on separate support arms 34A, 34B and 35A, 35B results in minimal "shingling" of documents when a stack of documents exit the document registration apparatus. This is because rollers 32 and 33 and sets of arms 34A, 34B and 35A, 35B can move away from transport system 11 as required by the thickness of document 12 to allow document 12 to pass, Without lifting the remainder of unit 20.

As shown in FIGS. 3 and 4, document registration unit 20 is preferably formed from one-piece document registration unit holder 45, to which a one piece frame 20B is pivotally attached. Frame 20B comprises stops 21–24 and arms 25A–B and 26A–B. Because document registration frame 20B is formed from a one-piece member, it is less subject to mechanical failure than registration devices formed from multiple interconnected parts. Furthermore, because registration stops 21–24 are rigidly and pivotally linked to urge rollers 25 and 26, it is not necessary to align registration stops 21–24 relative to urge rollers 25 and 26 in order for the overall document registration apparatus to be properly aligned. Registration stops 21–24 are inherently aligned with urge rollers 25 and 26 because urge rollers arms 25A, 25B, 26A and 26B are part of the same one-piece member as registration stops 21–24.

Figure 6:
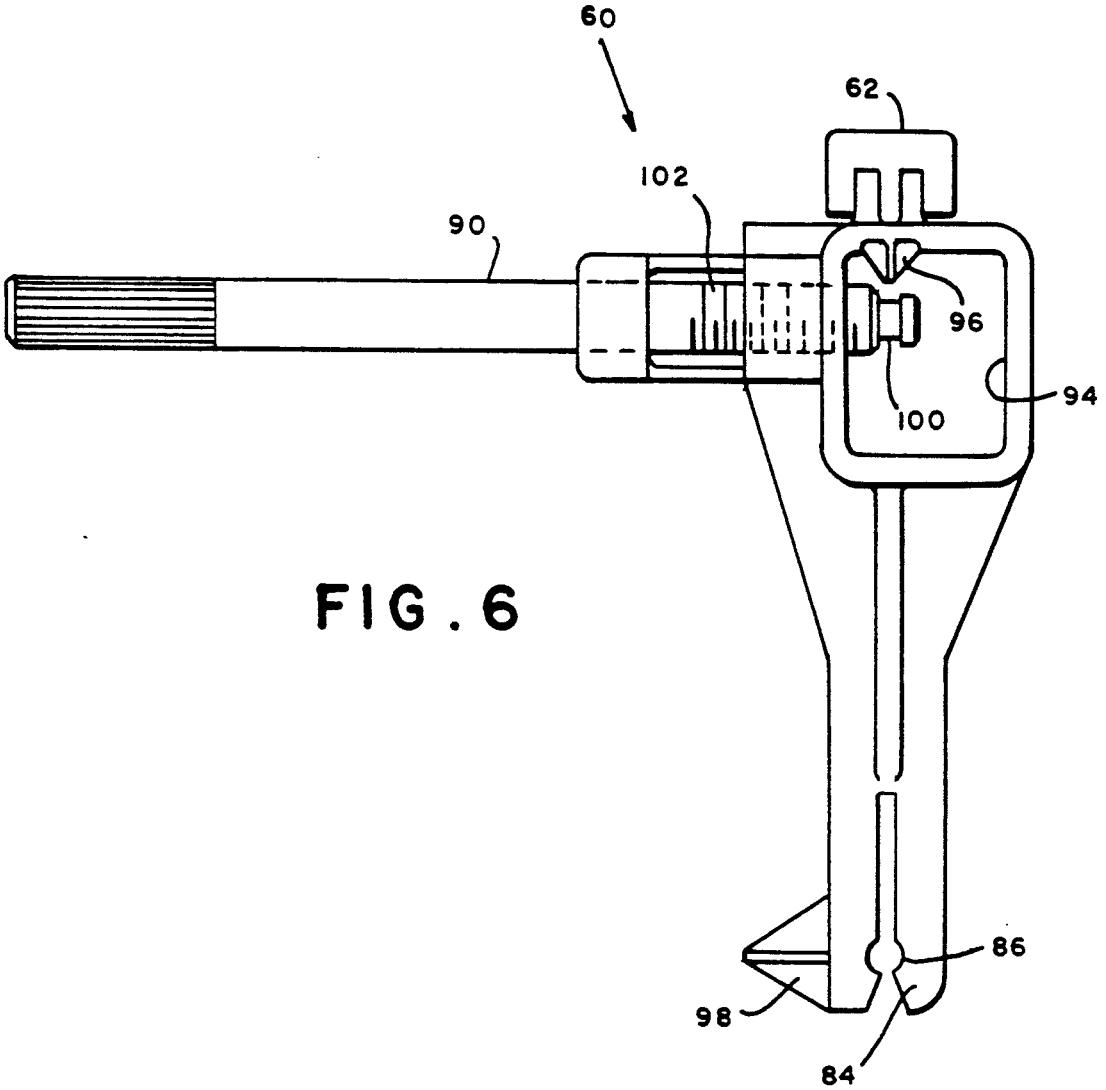
FIG. 6 is a top view of a slide member of the document registration apparatus of FIG. 1.

Top plate 18, which is suitably mounted to the frame of the inserting machine (not shown), supports document registration unit 20 which is mounted to the underside of plate 18 (FIGS. 1 and 4). Top plate 18 includes a longitudinal slot 56 which guides a slide member 60 as it moves back and forth on top of plate 18. Slide member 60 comprises a rectangular tang 62 molded to its upstream end and a pin clamping section at its downstream end (FIG. 6). Tang 62 fits through a close fitting rectangular aperture 64 at slot 56 in top plate 18. By inserting tang 62 into aperture 64 and then sliding slide member 60 to the rear of plate 18, tang 62 is trapped under top plate 18, whereby slide member can be positioned on plate 18 along slot 56.

A U-shaped bracket 70 is suitably mounted to the top side of document registration unit 20. In the preferred embodiment of the present invention each leg 72 and 74 of bracket 70 includes a flange member 76 and 78 which is secured to registration unit 20 by screws. Solenoid 27 is fixedly mounted to one leg 76 of bracket 70. The top portion of bracket 70 includes a pin 80 in the middle of the downstream side of bracket 70, and a tab 82 in the middle of the upstream side.

Shaft 90 has a groove 100 at one end and a knurled surface at the other end. There is a threaded section 102 adjacent groove 100. Slide 60 includes a mating thread molded into it to accept threaded section 102 of shaft 90.

Bracket 70 is assembled to top plate 18 in the following manner. Bracket 70 is lifted up against the underside of plate 18 with pin 80 and tab 82 protruding through slot 56. Slide 60 includes a slotted clamp member 84 with a cutout portion 86 for retaining pin 80 and an aperture 94 through which tab 82 extends when bracket 70 is assembled to top plate 18. Slide 60 is positioned over slot 56 with clamp member 84 adjacent pin 80. Slide 60 is then slid forward causing pin 80 to be locked in place at cutout 86 of slotted clamp member 84 and tab 82 to be locked in place on groove 100. Thus registration unit 20 is slidably mounted to top plate 18.

Figure 7:
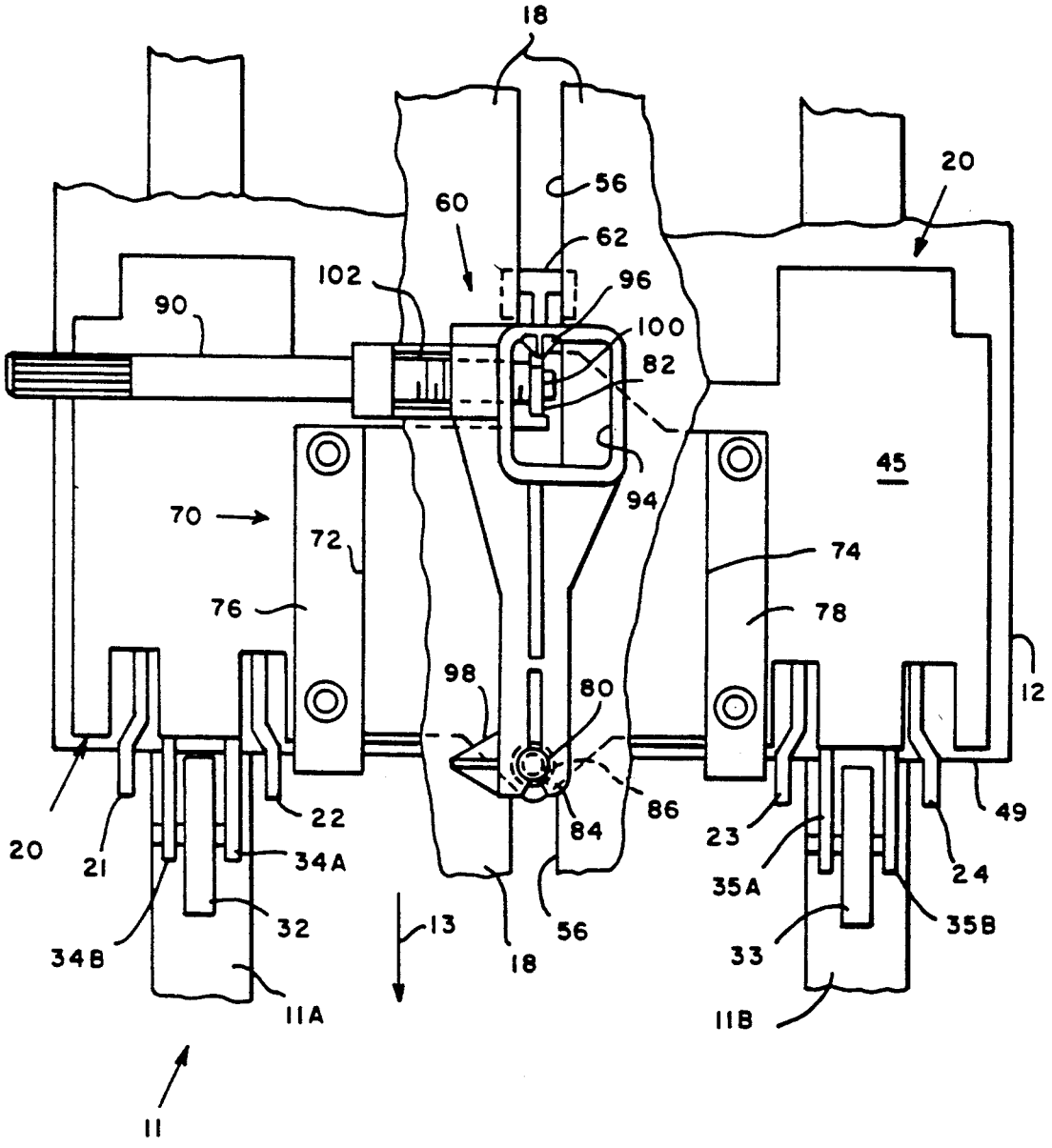
FIG. 7 is a top view of the document registration apparatus of FIG. 1 showing the relationship among the components effecting the skew adjustment.

The pivotal adjustment about pin 80 is implemented by shaft 90. As best shown in FIG. 7, when shaft 90 is rotated clockwise, it is threaded into slide 60 causing groove 100 to move towards the rear of the machine. Tab 82 moves with groove 100 causing the pivotal rotation of the registration unit 20 around pin 80 in a clockwise direction. This causes the stops 21, 22, 23 and 24 and rollers 32 and 33 to rotate accordingly. It will be understood that rotating shaft 90 counter-clockwise has the opposite effect.

Slide 60 includes a pointer member 96 which indicates how much skew is introduced and the direction of the skew at registration apparatus 10. Slide 60 further includes a molded pointer 98 which indicate..s the length of insert the registration apparatus 10 has be adjusted to handle.

Further details regarding the basic document registration apparatus 10 may be obtained from the above noted U.S. patent application Ser. No. 808,863.

Thus it is seen that the present invention provides skew adjustment means to a document registration apparatus that has a design that does not result in frequent mechanical failure, that has minimum number of mechanical parts, that is not difficult to align, that can simultaneously align a stack of documents without shingling, and which allows easy access to jammed documents. One skilled in the art will appreciate that the present invention can be practiced by other than the described embodiments, which are presented for purposes of illustration and not of limitation, and the present invention is limited only by the claims which follow.

What is claimed is:

1. A document registration apparatus for use with conveying means for transporting a document along a path from an upstream direction to a downstream direction through a document registration position, said document registration apparatus comprising:

a document registration unit positioned above a document registration position in the document path, having:

a plurality of laterally-spaced registration stops at a downstream end of said registration unit positioned substantially perpendicular to the document path for both stopping a document at the document registration position and for aligning the document relative to the document path when said stops are lowered adjacent to the document path; and first pivoting means for pivoting said registration stops about a horizontal axis in said registration unit for selectively lowering said stops adjacent to the document path and raising said stops whereby conveying means transport said document from said registration position;

said document registration apparatus further comprising:

second pivoting means for pivoting said documentation registration unit about a vertical axis for skew adjustment of said registration unit.

2. The apparatus of claim 1 wherein said second pivoting means includes a bracket rigidly mounted to said registration unit, said bracket having a pin defining said vertical axis at a downstream end of said bracket and a tab at an upstream end of said bracket.

3. The apparatus of claim 2 wherein said second pivoting means further includes a top plate and means for pivotally securing said pin to said top plate, said top plate having an opening through which said tab protrudes, said opening being suitable for moving said tab in one of a clockwise and counterclockwise direction about said pin.

4. The apparatus of claim 3 wherein said second pivoting means further includes means for selectively moving said tab a desired distance in one of the clockwise and counterclockwise direction for said skew adjustment.

5. The apparatus of claim 2 wherein said first pivoting means comprises a rotary solenoid mounted to said bracket.

6. The apparatus of claim 1 wherein the laterally-spaced registration stops comprise two sets of two stops per set.

7. The apparatus of claim 6 wherein associated with each of said set of registration stops is a corresponding urge roller longitudinally aligned with its corresponding set of registration stops.

8. The apparatus of claim 7 wherein for each of said urge rollers, the document registration unit further comprises two corresponding urge roller arms.

9. The apparatus of claim 8 wherein said urge roller arms and the laterally-spaced registration stops are formed from the same one-piece member.

10. The apparatus of claim 1 further comprising a plurality of exit pinch rollers positioned adjacent to and downstream from the laterally-spaced registration stops for urging a document against the conveying means in order to transport the document away from the document registration position in the downstream direction.

11. The apparatus of claim 10 wherein the exit pinch rollers are independently pivotally attached to the document registration unit horizontal axis.

12. A document registration apparatus for use with a conveying means for transporting a document along a path from an upstream direction to a downstream direction through a document registration position, said document registration apparatus comprising:

a document registration unit positioned above the document path adjacent to the document registration position, having:

an upstream end, a downstream end and a horizontal axis positioned in between the upstream end and the downstream end, a plurality of laterally-spaced registration stops at the downstream end of the unit positioned substantially perpendicular to the document path for both stopping a document at the document registration position and for aligning the document relative to the document path when said stops are pivoted adjacent to the document path, and at least one urge roller at the upstream end of the unit for urging a stopped document against the conveying means when said stops are pivoted away from the document path to move the document from the document registration position in the downstream direction; and first pivoting means for pivoting said registration stops about a horizontal axis in said registration unit for selectively lowering said stops adjacent to the document path and raising said stops whereby said conveying means transports said document from said registration position;

said document registration apparatus further comprising:

second pivoting means for pivoting said documentation registration unit about a vertical axis for skew adjustment of said registration unit.

13. The apparatus of claim 12 wherein said second pivoting means includes:

a bracket rigidly mounted to said registration unit, said bracket having a pin defining said vertical axis at a downstream end of said bracket and a tab at an upstream end of said bracket;

a top plate and means for pivotally securing said pin to said top plate, said top plate having an opening through which said tab protrudes, said opening being suitable for moving said tab in one of a clockwise and counterclockwise direction about said pin; and means for selectively moving said tab a desired distance in one of the clockwise and counterclockwise direction for said skew adjustment.

14. The apparatus of claim 13 wherein the pivoting means comprises a rotary solenoid mounted to said bracket.

15. The apparatus of claim 14 wherein the laterally-spaced registration stops are substantially perpendicular to the document path when the downstream end of the registration unit is pivoted adjacent to the document path.

16. The apparatus of claim 15 wherein the laterally-spaced registration stops comprise two sets of two stops per set.

17. The apparatus of claim 16 wherein associated with each set of registration stops is a corresponding urge roller longitudinally aligned with its corresponding set of registration stops.

18. The apparatus of claim 17 wherein for each urge roller, the document registration unit further comprises two corresponding urge roller arms.

19. The apparatus of claim 18 wherein the urge roller arms and the laterally-spaced registration stops are formed from the same one-piece member.

20. The apparatus of claim 19 further comprising a plurality of exit pinch rollers positioned adjacent to and downstream from the laterally-spaced registration stops for urging a document against the conveying means in order to transport the document away from the document registration position in the downstream direction.

21. The apparatus of claim 20 wherein the exit pinch rollers are independently pivotally attached to the document registration unit horizontal axis.

* * * * *